United States Patent [19]

Anthony

[11] Patent Number: 4,897,528

[45] Date of Patent: Jan. 30, 1990

[54] KILN WITH CONTAMINANT AFTER-BURNER

[76] Inventor: Frank H. Anthony, 326 Atherton Dr., Metaire, La. 70005

[21] Appl. No.: 171,490

[22] Filed: Mar. 21, 1988

[51] Int. Cl.[4] ..... H05B 1/02

[52] U.S. Cl. ..... 219/497; 219/494; 219/413; 219/360; 219/393; 432/120; 432/72

[58] Field of Search ..... 219/490, 491, 494, 497, 219/501, 507, 393, 508, 483, 486, 360, 411"414; 432/120, 72; 307/117

[56] References Cited

U.S. PATENT DOCUMENTS

| | | | |
|---|---|---|---|
| 3,794,459 | 2/1974 | Meenan | 432/72 |
| 4,115,317 | 9/1978 | Spater | 432/72 |
| 4,240,787 | 12/1980 | Jamaluddin | 432/72 |
| 4,398,472 | 8/1983 | Burke et al. | 432/72 |
| 4,431,405 | 2/1984 | Eatherton | 432/120 |
| 4,460,332 | 7/1984 | Lawler et al. | 432/72 |
| 4,662,840 | 5/1987 | Ellison | 432/72 |
| 4,751,886 | 6/1988 | Kopks et al. | 432/72 |

*Primary Examiner*—M. H. Paschall

*Attorney, Agent, or Firm*—Nixon & Vanderhye

[57] ABSTRACT

A contaminant elimination system is disclosed which eliminates (or dramatically reduces) the contaminating components in, for example, exhaust gas from a kiln by enclosing the kiln gas venting channel and processing the exhaust gas by the contaminant eliminator system. This system includes a heating element which is disposed adjacent to the gas venting channel. The heating element is controlled to heat the kiln exhaust gas to a temperature (e.g., 1800°) at which many of the contaminating gases change to a less harmful state. The heated exhaust gas is directed along a winding cooling path where metallic particles in contaminated exhaust gas compounds are plated on relatively cold condensing plates. The cooled exhaust gas is then filtered to trap substantially all remaining airborne metallic or other contaminating particles.

27 Claims, 2 Drawing Sheets

FIG. 1
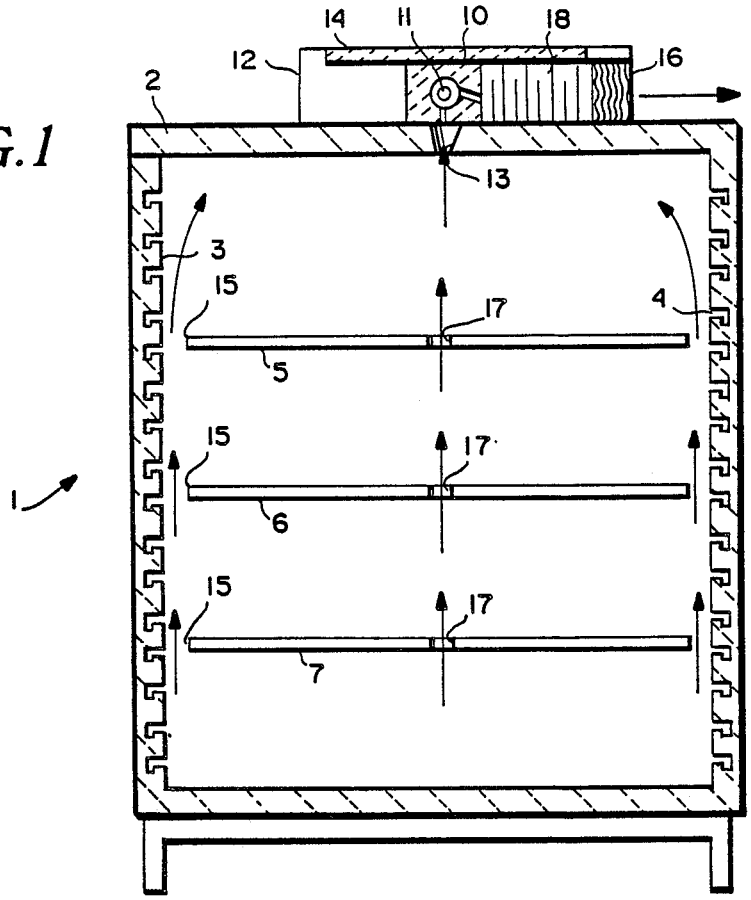
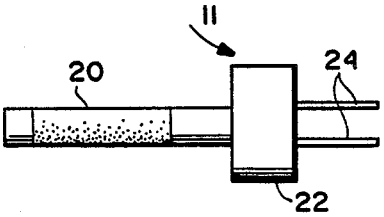
FIG. 2
FIG. 3
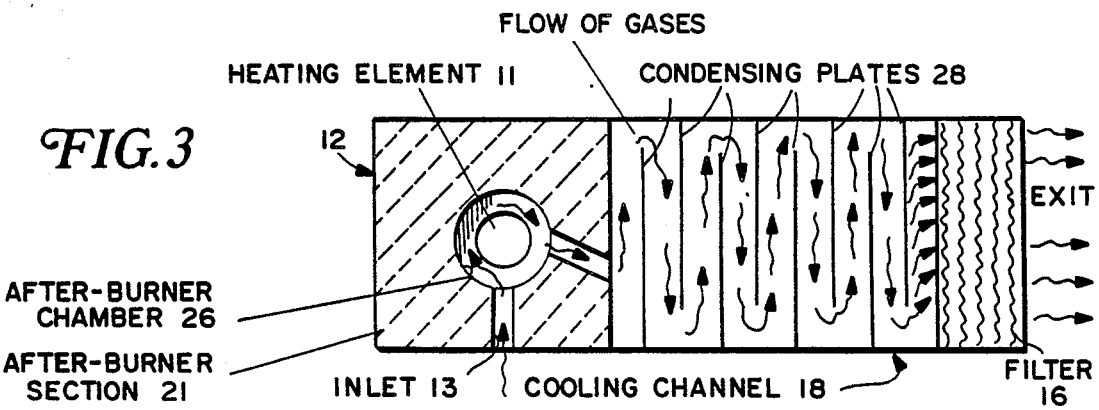

KILN WITH CONTAMINANT AFTER-BURNER

FIELD OF THE INVENTION

This invention relates to an improved kiln. More particularly, the invention relates to an improved hobbyist kiln that includes a contaminant eliminator system including an after-burner section for eliminating harmful exhaust gases generated within the kiln.

BACKGROUND AND SUMMARY OF THE INVENTION

"Kiln" is a term of art which designates a type of oven used for firing ceramic wares. A hobbyist kiln, as used herein, refers to a kiln designed for use in a household which is generally smaller and constructed much more cheaply than its commercial counterpart.

In either a hobbyist or commercial kiln, ceramic material such as any member of the class of materials commonly designated as "clay", is wetted into a plastic mass and preshaped prior to being dried and then fired in the kiln into a permanently rigidized or sintered structure. The fired object is usually somewhat smaller than its unfired counterpart resulting in a product of increased strength and density.

During the firing process, a wide range of potentially hazardous chemicals are emitted from the fired object depending upon the particular clay composition utilized. At relatively low temperatures various organic compounds are emitted from the heated clay in gaseous form. More particularly, depending upon the composition of the clay material, gases containing arsenic and formaldehyde are generated at such low temperatures. At higher temperatures, metallic based gases are emitted. Additionally, for example, if a gold glaze is placed on the fired object, noxious gases are emitted at a relatively high temperature originating from the compound within which the gold particles are suspended.

Commercial kilns are typically operated to vent emitted gases out of the area in which the kilns are located. These commercial kilns are typically gas fired. In such kilns, emitted gases are oxidized to such an extent that hazardous chemicals are present at a relatively low concentration.

Hobbyist kilns are typically electrically fired. In such kilns, oxidation of emitted hazardous gases does not takes place. Additionally, operators of such hobbyist kilns are often not well informed as to the need to properly vent the kiln exhaust. Accordingly, a greater potential danger exists for the hobbyist kiln operator to be exposed to a dangerously high concentration of hazardous gas than a typical commercial kiln operator.

The exemplary embodiment of the present invention eliminates (or dramatically reduces) the contaminating components in the kiln exhaust gas by enclosing the kiln gas venting channel within the disclosed contaminant eliminator system. This system includes a heating element which is disposed adjacent to the gas venting channel. The heating element is controlled to heat the kiln exhaust gas to a temperature (e.g., 1800° ) at which many of the contaminating gases change to a less harmful state. The heated exhaust gas is directed along a winding cooling path where metallic particles in the contaminated exhaust gas compounds are plated on relatively cold condensing plates. The cooled exhaust gas is then filtered to trap substantially all remaining airborne metallic or other contaminating particles.

Although the exemplary embodiment of the present invention is directed to eliminating emitted hazardous exhaust gases from kilns, the present invention may be advantageously applied to contaminating gas elimination from the exhaust of a potentially wide range of chemical process confining enclosures. For example, the present invention in addition to electric and gas kiln applications, may be advantageously used in conjunction with incinerators, furnaces, chemical process exhaust smoke stacks and other applications.

BRIEF DESCRIPTION OF THE DRAWINGS

These as well as other features of this invention will be better appreciated by reading the following detailed description of the presently preferred embodiment taken in conjunction with the accompanying drawings of which:

FIG. 1 is a simplified representation of a frontal cross-section of a hobbyist kiln modified in accordance with an exemplary embodiment of the present invention;

FIG. 2 is a side view of the heating element used in the after-burner section of the embodiment shown in FIG. 1;

FIG. 3 is a side view cross-section of the contaminant eliminator system generally shown in FIG. 1;

DETAILED DESCRIPTION OF THE DRAWINGS

Figure 4:
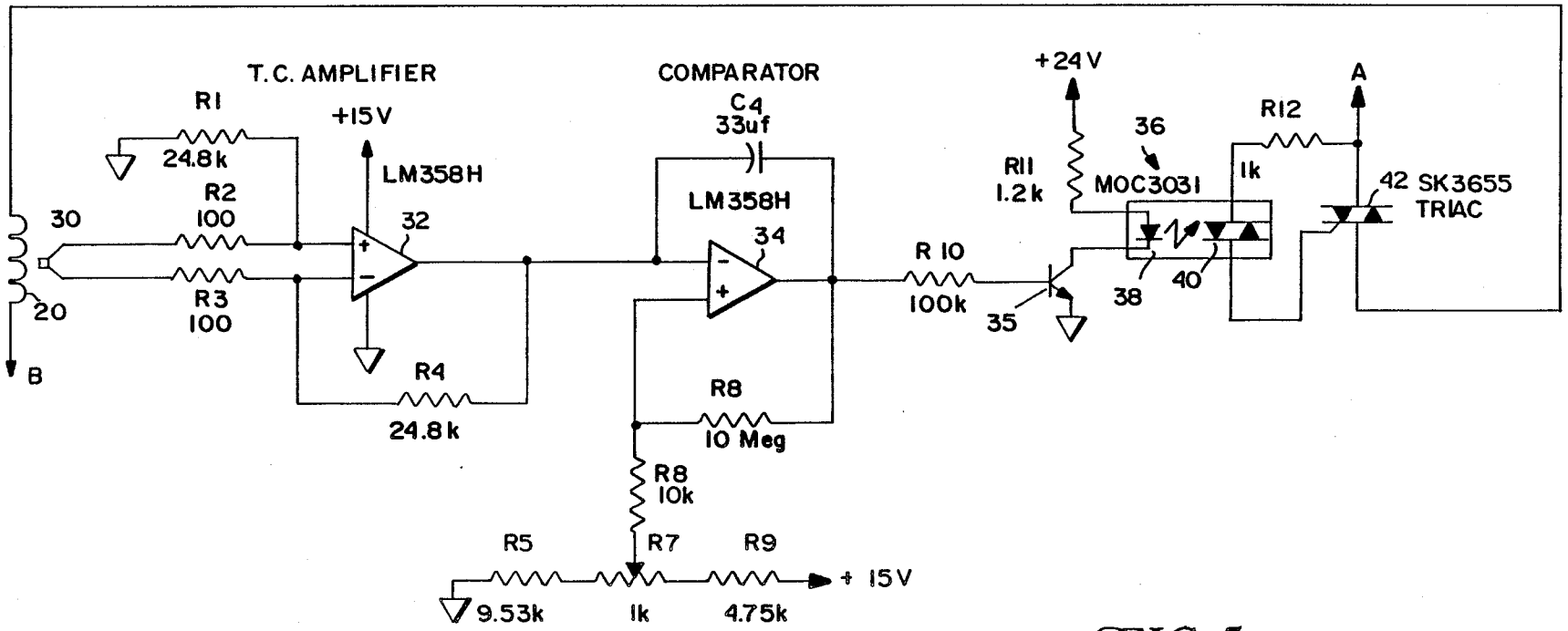
FIG. 4 is an exemplary control circuit used to control the temperature of the heating element shown in FIG. 2.

FIG. 1 is a cross-section of a hobbyist kiln 1 modified to incorporate an exemplary contaminant eliminator system 12 of the present invention. As will explained further below, the contaminant eliminator system 12 may be applied to systems other than the electrical ceramic furnace disclosed by way of example only in FIG. 1.

Except for the contaminant eliminator system 12, the kiln 1 shown in FIG. 1 may, for example, be of the type disclosed in U.S. Pat. No. 4,536,153. The electronics for controlling the firing cycle of the kil 1 (while not being particularly germane to the present invention) may, for example, be of the type disclosed in U.S. Pat. No. 4,451,726.

The kiln 1 includes a top loading cabinet having a door generally designated at 2 and a refractory liner 3 which lines the whole of the heating cavity and which is capable of withstanding the temperatures used for firing. That portion of the refractory liner 3 which lines the sides of the kiln is commonly provided with channels 4 on its side into which are placed heating means such as resistive heating coils (not shown).

Schematically shown is a series of shelf units 5, 6 and 7 which compartmentalize the heating cavity and onto which the ceramic objects to be fired are placed. The three shelf units are shown for purposes of illustration only. Not shown are the spacing means which support the shelves as a tiered arrangement in fixed, but adjustable relation to each other. As disclosed in the aforementioned U.S. Pat. No. 4,536,153, the shelves 5, 6, and 7 have at least a single hole located in the geometric center of each shelf. Shelves 5, 6, and 7 may be of the design shown in U.S. Pat. No. 4,536,153.

An exemplary contaminant eliminator system (which is shown in further detail in FIG. 5) is generally represented at 12 in FIG. 1. The eliminator system 12 includes an enclosure having a kiln exhaust gas venting channel 13 through which contaminating chemicals enter the contaminant eliminator system. The contaminant eliminator system 12 includes a high temperature after-burner 10 having a heating element 11 and associated heating element control circuitry (which is discussed in detail below). The contaminant eliminator system 12 further includes insulation 14, a gas cooling channel 18 and a contaminant filter 16 (which may be a conventional activated charcoal filter).

In operation, as the kiln 1 is heated during the ceramic firing process, contaminating gases are emitted and travel to the top of the kiln by passing through the annular spaces 15 between the shelf periphery and the liner 3 as well as through the apertures 17 at the center of each shelf. The hot gases which are expelled from kiln 1 through vented channel opening 13 are passed to the after-burner section 10.

After-burner 10 includes a heating element 11 that is controllably heated to 1800° F. within approximately 20 seconds after initial after-burner turn-on in a manner which will be described in detail below. The heating element 11 is turned on at the same time that the kiln 1 firing cycle is initiated. Upon being exposed to the 1800° F. temperature generated by heating element 11 most of the organic compound based contaminating gases are oxidized or otherwise converted to forms which are either harmless or far less harmful than the originally emitted gases.

The heating element 11 of after-burner 10 shown in FIG. 1 is preferably made of silicon carbide. A side view of the heating element 11 is shown in FIG. 2. The heating element 11 includes a silicon carbide heating element 20, a porcelain insulated base 22 and wire leads 24 which are supplied 110 volts in a manner which will be described in conjunction with FIGS. 4 and 5 below. The heating element must be designed to generate extremely high temperatures in a confined area without burning out. The heating element 11 described above is preferably a Silicon Carbide Igniter Element Model No. 0206RC031 manufactured by Carborundum Division of Sohio Corporation.

FIG. 3 is a more detailed frontal cross-section of the contaminant eliminator system 12 of FIG. 1 at 12. The contaminant eliminator system 12 includes an after-burner section 21, a cooling channel 18, and a filter section 16.

The after-burner section 21 is entered via the gas venting channel 13 of kiln 1. Gases passing through the inlet 13 enter an after-burner chamber 26 (which is a chamber surrounded by refractory material) within which heating element 11 is disposed. FIG. 3 shows a side view of heating element 11 looking towards the cylindrical insulator base 22 shown in FIG. 2.

As noted above, organic compound based gases upon passing into after-burner chamber 26 with its heating element 11 will typically oxidize and change states such that they are rendered relatively harmless. On the other hand, many metallic compound based gases will not oxidize to a vapor state which is harmless.

Figure 5:
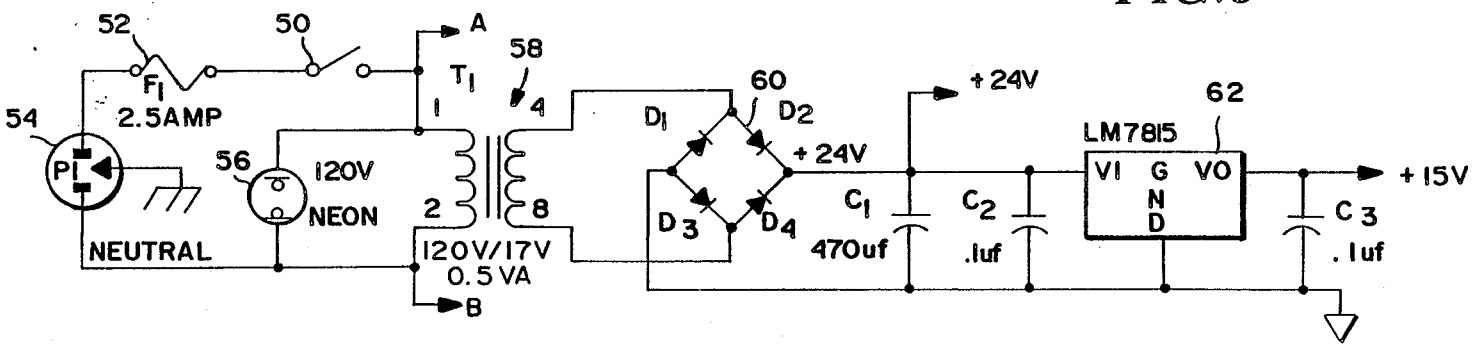
FIG. 5 is an exemplary power supply circuit used to supply power to the heating element and control circuit shown in FIG. 4.

Gases exiting after-burner section 21 via exit port 27 immediately enter a particle filtering cooling channel 18 as shown in FIG. 5. The gases entering the cooling channel 18 strike condensing plates 28. The plates 28 are metallic and must be of a large enough surface area to condense the gases being vented from kiln 1. The metal particles in the vented gases which include metallic based compounds, upon striking the relatively cold metal plates 28, tend to be deposited thereon due to condensation.

While the metal particles are thereby trapped on the plates 28, the remaining gases flow through a winding path defined by the plates 28 to slow down the gas flow and permit the gases to cool. Any airborne metallic or other contaminating particles present in the gas flow are captured by contaminant filter 16 shown in FIG. 3. The filter 16 may be, for example, an activated charcoal filter which must periodically be changed.

FIG. 4 shows an exemplary electronic control circuit which controls the heating and maintenance of the silicon carbide heating element 20 shown in FIG. 2 at its operating temperature. In this regard, the circuit of FIG. 4 insures that the temperature of the silicon carbide heating element 20 rises to 1800° (plus or minus 14° ) in approximately 20 seconds after being energized.

The heating element 20 and the circuit of FIG. 4 receive power via the power supply circuit described below in conjunction with FIG. 5. Although component values are shown in the applicant's FIGS. 4 and 5, for resistors, capacitors, etc., it should be understood that such component values (as well as component model numbers shown) are illustrative only and are in no way limiting to the present invention.

Turning to FIG. 4, a thermocouple 30 (e.g., a type K thermocouple which generates approximately 40.6 mv at 1800° F.) is mounted in the after-burner chamber 26 directly adjacent to heating element 20 so as to be thermally coupled thereto. The thermocouple 30 generates a voltage which is indicative of the temperature of heating element 20.

The temperature indicating voltage generated by thermocouple 30 is fed to thermocouple signal amplifier 32 via impedance matching resistors R2 and R3. Resistor R1 which is connected to the non-inverting input of amplifier 32 and to ground (as indicated by the triangular symbol) provides an appropriate bias voltage to the non-inverting input of amplifier 32.

Amplifier 32 generates an amplified output voltage which is proportional to the temperature of heating element 20. Feedback resistor R4 is connected between the output of amplifier 32 and the inverting input of amplifier 32 and provides a gain control element whose value varies the output voltage.

The heating element temperature indicating output voltage of amplifier 32 is fed to the inverting input of operational amplifier 34 which is operating as a comparator. The non-inverting input of comparator 34 is connected to the temperature set point adjust resistor string R5, R6, R7 and R9.

Potentiometer R7 is adjusted by the manufacturer to a point at which heating element 20 maintains a temperature of 1800° F. (plus or minus a predetermined tolerance range).

Resistor R8 is a feedback resistor which sets the gain of operational amplifier 34. By appropriately selecting resistor R8, the heating element temperatures at which transistor 35 is turned on or turned off may be controlled. In this fashion, heating element 20 is energized when its temperature dips a predetermined amount below 1800° F. and is turned off when its temperature rises a predetermined amount above 1800° F.

As noted above, 1800° F. is the temperature at which contaminated exhaust gases emanating from kiln 1 are oxidized and rendered harmless. In order to insure that all contaminated gases which are emitted during the firing process are oxidized, the circuit shown in FIG. 4 is energized (as will be explained below by the closing of switch 50 shown in FIG. 5) as soon as the kiln is turned on to begin a firing cycle. This is necessary since some of the contaminating chemicals in various organic compound containing gases are emitted from the clay at relatively low temperatures between 50° and 500° F. Various hazardous metallic compound containing gases are generally emitted in the range between 250° F. and 1800° F. Accordingly, it is important for the heating element 20 to be operative during essentially the entire kiln firing cycle.

Turning back to FIG. 4, the output of comparator 34 generates a heating element turn-on signal by providing turn-on control current via resistor R1O to the base of transistor 35. The output of comparator 34 is also coupled to a filtering capacitor C4 which is fed back to the inverting input of comparator 34.

Upon receiving a heating element turn-on control signal from comparator 34, transistor 35 is turned on and conducts current for driving the heating element's optically isolated driving element 36. The heating element driving circuit 36 includes a light emitting diode 38 and a triac trigger 40. Optical driving circuit 36 protects low voltage amplifiers 32 and 34 which are electrically isolated from the 110 volt power supply connected to heating element 20.

When transistor 35 is turned on, current flows through light emitting diode 38 due to the 24 volt bias voltage which initiates current flow through R11, and transistor 35 to ground. Photosensitive triac 40 is then turned on which, in turn, turns on triac 42. Resistor R12 is a current limiting resistor which limits the current flow into the gate of triac 42. Upon receiving a control signal on its gate, triac 42 (which may, for example, be a 7 amp triac) permits heating element 20 to be energized via voltage applied across terminals A and B as is explained further below in regard to the power supply circuit shown in FIG. 5.

Turning to FIG. 5, AC power plug 54 serves to connect 120 volts AC to the primary winding of transformer 58 via fuse 52 and power switch 50. The power supply circuit also includes a "power on" indicator 56 which reminds the operator to turn off power switch 50 when the kiln turns off. It should be recognized that an automatic after-burner turn-off control circuit may be utilized as opposed to relying on the operator to manually turn off the heating element control circuit. The 120 volts AC is also fed to terminals A and B in FIG. 5 which in turn feeds this voltage to points A and B shown in FIG. 4 to thereby energize heating element 20 under the conditions discussed above with respect to FIG. 4.

At the low voltage side of transformer 58, a reduced voltage, e.g., 17 volts AC, is fed to a diode bridge rectifier 60. Diodes D1 through D4 convert the AC voltage to a DC voltage in order to supply the DC bias voltages required in FIG. 4. The DC voltage is filtered via capacitors C1 and C2 and is fed to a voltage regulator 62 (whose output is in turn filtered by capacitor C3). The 24 volts generated at bridge rectifier 60 is utilized as the bias voltage for light emitting diode 38 as shown in FIG. 4. The 15 volts generated at the output of voltage regulator 62 is similarly utilized as the bias voltage for amplifiers 32 and 34 as also shown in FIG. 4.

While the exemplary embodiment has been described in conjunction with an electric kiln, the present invention may likewise be utilized in a wide variety of kilns other than the hobbyist kiln described above. The invention may be applied to both electric kilns and gas kilns.

It is also contemplated by the present invention that the contaminant eliminator system described above may be applied to other enclosed structures within which hazardous gases are generated and thereafter vented. For example, the present invention may be advantageously applied in conjunction with incinerators, chemical or other manufacturing process exhaust smoke stacks or even in the printing art in conjunction with printing presses which apply heat to the printing ink to change its characteristics (and in so doing generate hazardous gases which are vented from the press). The particular size and design of the contaminant eliminator system must be tailored to meet the needs of the particular application taking into consideration, for example, the volume of contaminant gases which are being generated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A kiln for firing ceramic wares, comprising:

means defining a kiln firing chamber for substantially enclosing ceramic wares to be fired, said chamber defining means including a gas venting channel through which emitted gas resultant from firing the wares is vented from said chamber defining means;

a contaminant eliminator system for said kiln including a housing in communication with said venting channel for receiving the emitted gas, a heating element means disposed within said housing and adjacent said gas venting channel to heat the gas resultant from firing the wares and emitted from said kiln chamber to a predetermined high temperature, said heating element means including:

a heating element;

means for detecting the temperature of said heating element and for generating a detected heating element temperature signal indicative of the heating element temperature; and control means responsive to said detected heating element temperature signal for maintaining said heating element at substantially said predetermined high temperature; and filter means for receiving gas which has been heated by said heating element means for removing contaminants therefrom.

2. A kiln according to claim 1, said filter means including cooling means for receiving gas heated by said heating element means for cooling said gas and for removing predetermined contaminants from said gas.

3. A kiln according to claim 2, wherein said cooling means includes plate means for trapping contaminating particles in said gas through condensation of said particles and for providing a cooling path for said gas.

4. A kiln according to claim 1, wherein said heating element means comprises a silicon carbide heating element.

5. A kiln according to claim 1, wherein said filter means comprises an activated charcoal filter.

6. A kiln according to claim 1, wherein said control means includes:

means for generating a desired heating element temperature signal indicative of said predetermined high temperature;

comparator means for comparing said desired heating element temperature signal with said detected heating element temperature signal and for generating a heating element control signal when a temperature adjustment is required; and temperature control means responsive to said heating element control signal for raising the temperature of said heating element temperature at a predetermined temperature below said predetermined high temperature and for allowing said heating element to cool when said detected heating element temperature is at a predetermined temperature above said predetermined high temperature.

7. A kiln according to claim 6, wherein said temperature control means includes:

power supply means for supplying electrical energy to said heating element means; and trigger means coupled to said comparator means and said power supply means and responsive to said heating element control signal for supplying high voltage to said heating element.

8. A kiln according to claim 7, wherein said trigger means includes:

optical means responsive to said heating element control signal for generating an optical trigger signal;

switch means responsive to said optical trigger signal for supplying high voltage to said heating element.

9. A kiln for firing ceramic wares, comprising:

means defining a kiln firing chamber for substantially enclosing ceramic wares to be fired, said chamber defining means including a gas venting channel through which emitted gas resultant from firing the wares is vented from said chamber defining means:

a contaminant eliminator system for said kiln including a housing in communication with said venting channel for receiving the emitted gas, a heating element means disposed within said housing and adjacent said gas venting channel to heat the gas resultant from firing the wares and emitted from said kiln chamber to a predetermined high temperature; and filter means for receiving gas which has been heated by said heating element means for removing contaminants therefrom, said filter means including an activated charcoal filter, and plate means for trapping contaminating particles in said gas through condensation of said particles and for providing a cooling path for said gas for delivery thereof to said activated charcoal filter.

10. A kiln according to claim 9, wherein said heating element means comprises a silicon carbide heating element.

11. A kiln according to claim 10, wherein said heating element means comprises:

a heating element;

means for detecting the temperature of said heating element and for generating a detected heating element temperature signal indicative of the heating element temperature; and control means responsive to said detected heating element temperature signal for maintaining said heating element at substantially said predetermined high temperature.

12. A kiln according to claim 11, wherein said control means includes:

means for generating a desired heating element temperature signal indicative of said predetermined high temperature;

comparator means for comparing said desired heating element temperature signal with said detected heating element temperature signal and for generating a heating element control signal when a temperature adjustment is required; and temperature control means responsive to said heating element control signal for raising the temperature of said heating element when said heating element is at a predetermined temperature below said predetermined high temperature and for allowing said heating element to cool when said heating element is at a predetermined temperature above said predetermined high temperature; and wherein said temperature control means includes:

power supply means for supplying electrical energy to said heating element means; and trigger means coupled to said comparator means and said power supply means and responsive to said heating element control signal for supplying high voltage to said heating element.

13. A kiln according to claim 12, wherein said trigger means includes:

optical means responsive to said heating element control signal for generating an optical trigger signal; and switch means responsive to said optical signal for supplying high voltage to said heating element.

14. A system for heating articles and eliminating contaminants from exhaust gases resultant therefrom, comprising an enclosure defining a heating chamber for the articles and for confining the gases resultant from the heating of the articles, said enclosure including a gas venting channel through which the gas is vented from said chamber to outside said enclosure;

means for eliminating the contaminants in the gas vented through said venting channel including a housing, a heating element means disposed within said housing and adjacent to said gas venting channel to heat vented gas to a predetermined high temperature, said heating element means including:

a heating element, means for detecting the temperature of said heating element and for generating a detected heating element temperature signal indicative of the heating element temperature, and control means responsive to said detected heating element temperature signal for maintaining said heating element at substantially said predetermined high temperature; and filter means for receiving gas which has been heated by said heating element means for removing contaminants therefrom.

15. A system according to claim 14, wherein said filter means includes cooling means for receiving gas heated by said heating element means for cooling said gas and for removing predetermined contaminants from said gas.

16. A system according to claim 15, wherein said means for receiving includes plate means for trapping contaminating particles in said gas through condensation of said particles and for providing a cooling path for said gas.

17. A system according to claim 16 wherein said heating element means comprises a silicon carbide heating element, said filter means comprising an activated charcoal filter.

18. A system according to claim 14, wherein said heating element means comprises a silicon carbide heating element.

19. A system according to claim 14, wherein said filter means comprises an activated charcoal filter.

20. A system according to claim 14, wherein said control means includes:

means for generating a desired heating element temperature signal indicative of said predetermined high temperature;

comparator means for comparing said desired heating element temperature signal with said detected heating element temperature and for generating a heating element control signal when a temperature adjustment is required; and temperature control means responsive to said heating element control signal for raising the temperature of said heating element when said detected heating element temperature is at a predetermined temperature below said predetermined high temperature and for allowing said heating element to cool when said detected heating element temperature is at a predetermined temperature above said predetermined high temperature.

21. A system according to claim 20, wherein said temperature control means includes:

power supply means for supplying electrical energy to said heating element means; and trigger means coupled to said comparator means and said power supply means and responsive to said heating element control signal for supplying high voltage to said heating element.

22. A system according to claim 21, wherein said trigger means includes:

optical means responsive to said heating element control signal for generating an optical trigger signal; and switch means responsive to said optical trigger signal for supplying high voltage to said heating element.

23. In a kiln for firing ceramic wares and having a gas venting channel through which emitted gas resultant from firing the wares is vented outside the firing chamber of the kiln, a method of eliminating contaminants from said emitted gas comprising the steps of:

enclosing said gas venting channel within a housing;

disposing a heating element adjacent said gas venting channel to heat gas emitted from said kiln to a predetermined high temperature;

detecting the temperature of said heating element and generating a detected heating element temperature signal indicative of the heating element temperature;

maintaining said heating element at substantially said predetermined high temperature; and filtering gas which has been heated by said heating element to thereby remove contaminant therefrom, said filtering step including the steps of:

trapping contaminating particle in said gas through condensation of said particles on at least one surface; and providing a cooling path for said gas.

24. A method according to claim 23, wherein said heating element comprises a silicon carbide heating element.

25. A method according to claim 23, wherein said maintaining step includes the steps of:

generating a desired heating element temperature signal indicative of said predetermined high temperature;

comparing said desired heating element temperature signal with said detected heating element temperature signal and generating a heating element control signal when a temperature adjustment is required; and raising the temperature of said heating element when said detected heating element temperature is at a predetermined temperature below said predetermined high temperature and allowing said heating element to cool when said detected heating element temperature is at a predetermined temperature above said predetermined high temperature.

26. For use with an enclosure within which contaminating gas is disposed, said enclosure having a gas venting channel through which said gas is vented, a method of eliminating contaminants from said gas comprising the steps of:

enclosing said gas venting channel within a housing;

disposing a heating element means within said housing and adjacent to said gas venting channel to heat said vented gas to a predetermined high temperature;

detecting the temperature of said heating element and generating a detected heating element temperature signal indicative of the heating elements temperature;

maintaining said heating element at substantially said predetermined high temperature; and filtering gas which has been heated by said heating element means to remove contaminants therefrom, said filtering step including the steps of:

trapping contaminating particle in said gas through condensation of said particles on at least one surface; and providing a cooling path for said gas.

27. A method according to claim 26, wherein said heating element comprises a silicon carbide heating element.

* * * * *